US006244085B1

(12) United States Patent
Dummermuth

(10) Patent No.: US 6,244,085 B1
(45) Date of Patent: Jun. 12, 2001

(54) PRESSING TOOL

(75) Inventor: Paul Dummermuth, Zunzgen (CH)

(73) Assignee: Von Arx AG, Sissach (CH)

( * ) Notice: Subject to any disclaimer, the term of this patent is extended or adjusted under 35 U.S.C. 154(b) by 0 days.

(21) Appl. No.: 09/499,163

(22) Filed: Feb. 7, 2000

(30) Foreign Application Priority Data

Feb. 11, 1999 (CH) ..... 0258/99

(51) Int. Cl.[7] ..... H01R 43/042

(52) U.S. Cl. ..... 72/31.1; 72/31.01; 72/37; 72/416; 72/453.16

(58) Field of Search ..... 72/453.16, 416, 72/31.01, 31.1, 20.1, 37; 29/720, 715

(56) References Cited

U.S. PATENT DOCUMENTS

| | | | | |
|---|---|---|---|---|
| 4,821,544 | * | 4/1989 | Tamlar | 72/37 |
| 5,461,893 | * | 10/1995 | Tyler | 72/37 |
| 5,490,406 | * | 2/1996 | College | 72/30.1 |
| 5,611,228 | * | 3/1997 | Dummermuth | 72/31.01 |
| 6,035,775 | * | 3/2000 | Ngheim | 72/416 |

FOREIGN PATENT DOCUMENTS

| | | |
|---|---|---|
| 196 31 019 A1 | 8/1997 | (DE) . |
| 0 712 696 B1 | 9/1995 | (EP) . |
| 0 858 850 A1 | 1/1998 | (EP) . |
| 0 941 812 A1 | 9/1999 | (EP) . |
| 0 941 813 A1 | 9/1999 | (EP) . |

* cited by examiner

*Primary Examiner*—Daniel C. Crane
(74) *Attorney, Agent, or Firm*—Pauley Petersen Kinne & Fejer

(57) ABSTRACT

A pressing tool for connecting pipe-shaped work pieces wherein the pressing tool has a fork-shaped receiver and a clamping tool interchangeably held in the receiver by a connecting bolt. The pressing tool has two clamping jaws which can be moved toward each other. A drive motor operates the clamping tool. The connecting bolt can be pushed through bores in the fork-shaped receiver and in the clamping tool, for maintaining the clamping tool in an exchangeable position within the fork-shaped receiver. A contactless electronic tracing device is arranged in the fork-shaped receiver, which determines a relative position of the clamping jaws in relation to the fork-shaped receiver. The contactless electronic tracing device also passes a signal to either an optical warning device or an acoustical warning device.

10 Claims, 5 Drawing Sheets

PRESSING TOOL

BACKGROUND OF THE INVENTION

1. Field of the Invention

This invention relates to a pressing tool for connecting pipe-shaped workpieces, having a fork-shaped receiver, a clamping tool, which is interchangeably held in this receiver by a connecting bolt and has two clamping jaws, which can be moved toward each other, and of a drive motor for operating the clamping tool. A connecting bolt can be pushed through bores in the fork-shaped receiver and in the clamping tool for interchangeably maintaining the clamping tool in the fork-shaped receiver.

2. Description of Prior Art

Pressing tools are known, which have pipe-shaped workpieces that are pressed together and two elements that are connected with each other in this way. Known cylinder-shaped workpieces are, for example, press sleeves, press fittings or connecting sleeves, as well as pipe sections, which can be pushed into each other and pressed together. These pressing tools are mostly constructed in a pistol shape and have a clamping tool. The clamping tool encloses a workpiece to be pressed. When the pressing tool is activated, the clamping jaws of the clamping tool are pressed together. So that various diameters of workpieces, such as coupling elements, can be processed by the same pressing tool if designed in such a way that appropriately dimensioned clamping tools can be simply exchanged.

The pressing tool has a fork-shaped receiver, in which the clamping tool is interchangeably held by a connecting bolt. The fork-shaped receiver and the clamping tool have bores for this purpose, through which passes the connecting bolt.

However, such pressing tools are tools with an increased accident risk. Several work accidents have already occurred, wherein the clamping tool was ejected in an uncontrolled manner and the fork-shaped receiver was bent open and deformed. Moreover, these pressing tools preform an increased number of incorrect pressings. Damages occur with both electro-mechanically and electro-hydraulically operated pressing tools.

In accordance with European Patent Reference EP-A-0 712 696, a monitoring element monitors the connecting bolt in its completely pushed-in position and is connected with the drive motor via a switch element.

Even if the clamping tool is correctly held in the pressing tool, this alone does not assure precise pressing of the pipe-shaped workpieces. The reasons for qualitatively unsatisfactory pressings can be of a wide variety. Besides functional reasons of the pressing tool, there are reasons which are connected with unsatisfactory processing. For example, the tool, or respectively the clamping jaws, can be dirty, so that sufficient closing of the clamping tool cannot be achieved, or the size of the pipe connector or pressing sleeve does not correspond to the size for which the corresponding tool is provided.

For these reasons a pressing tool was proposed in accordance with European Patent Reference EP-A-0 858 850, in which the length of the stroke of the drive which acts on the clamping tool is monitored. The appropriate length of the stroke for completely closing the clamping tool is known. This length of the stroke can also be indirectly determined, for example by a volumetric measurement of the hydraulic fluid in the case where the pressing tool is hydraulically operated. However, to monitor correctly, the pressing tool must determine which clamping tool is in use. Such a clamping tool determination requires an electronic data exchange between the clamping tool and the pressing tool, as well as appropriate electronic logic means, by which the information can be evaluated for appropriate signals that indicate a correct or an incorrect pressing operation. Such electronic monitoring devices then can be combined without problems with further electronic information, which also indicates the correct operation and the perfect state of the pressing tool.

Since these pressing tools are often employed at building sites, soiling, in particular of the clamping tool, can hardly be avoided. Such soiling then often leads to interruptions in the electronic transmission, and therefore to erroneous information.

A pressing tool is also described in German Patent Reference DE-A-19 631 019 wherein the final press position of the clamping jaws is monitored. Accordingly, the clamping tool can detect this final press position and pass it on to a display device. One problem with transmitting information from the clamping tool to the pressing tool remains. Appropriate electronics must be integrated into the clamping jaws in addition to elements which are also mechanically intricate. Here, the functional ability of the checking means is often hard to determine, and the user can also not see whether their functioning is still assured. Accordingly, the device continuously provides the information that the pressing process is unsatisfactory, while in actuality the pressing process is satisfactory, but there is an error in monitoring.

SUMMARY OF THE INVENTION

It is one object of this invention to provide a pressing tool that has two clamping jaws that move toward each other, which permits monitoring without an electronic data transmission from the clamping tool to the pressing tool, and which is as inexpensive as possible and allows the user to easily determine that the monitoring process is operational.

This object is achieved by a pressing tool discussed in this specification and in the claims.

BRIEF DESCRIPTION OF THE DRAWINGS

A preferred exemplary embodiment of this invention is shown in the drawings, wherein:.

DESCRIPTION OF PREFERRED EMBODIMENTS

Figure 1:
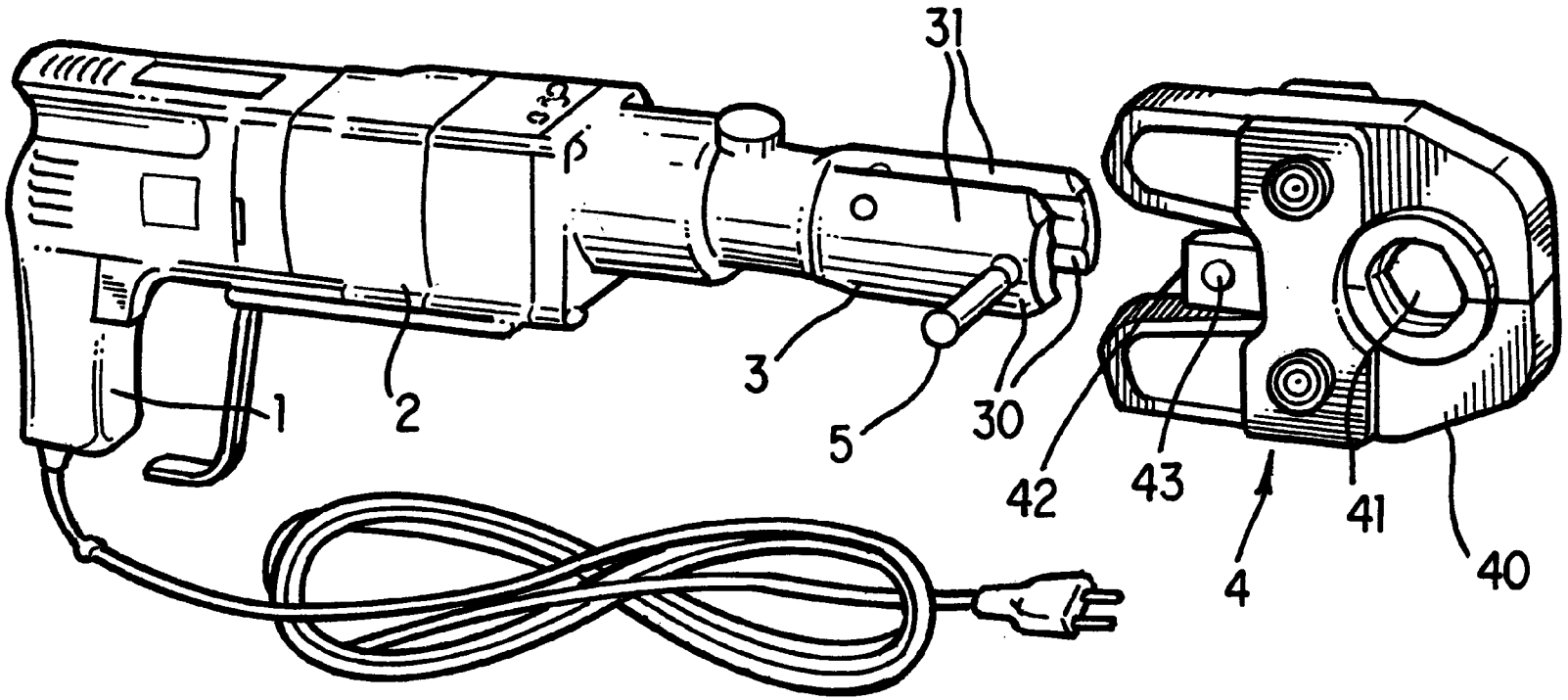
FIG. 1 shows a perspective view of a first pressing tool with a clamping tool.
Figure 2:
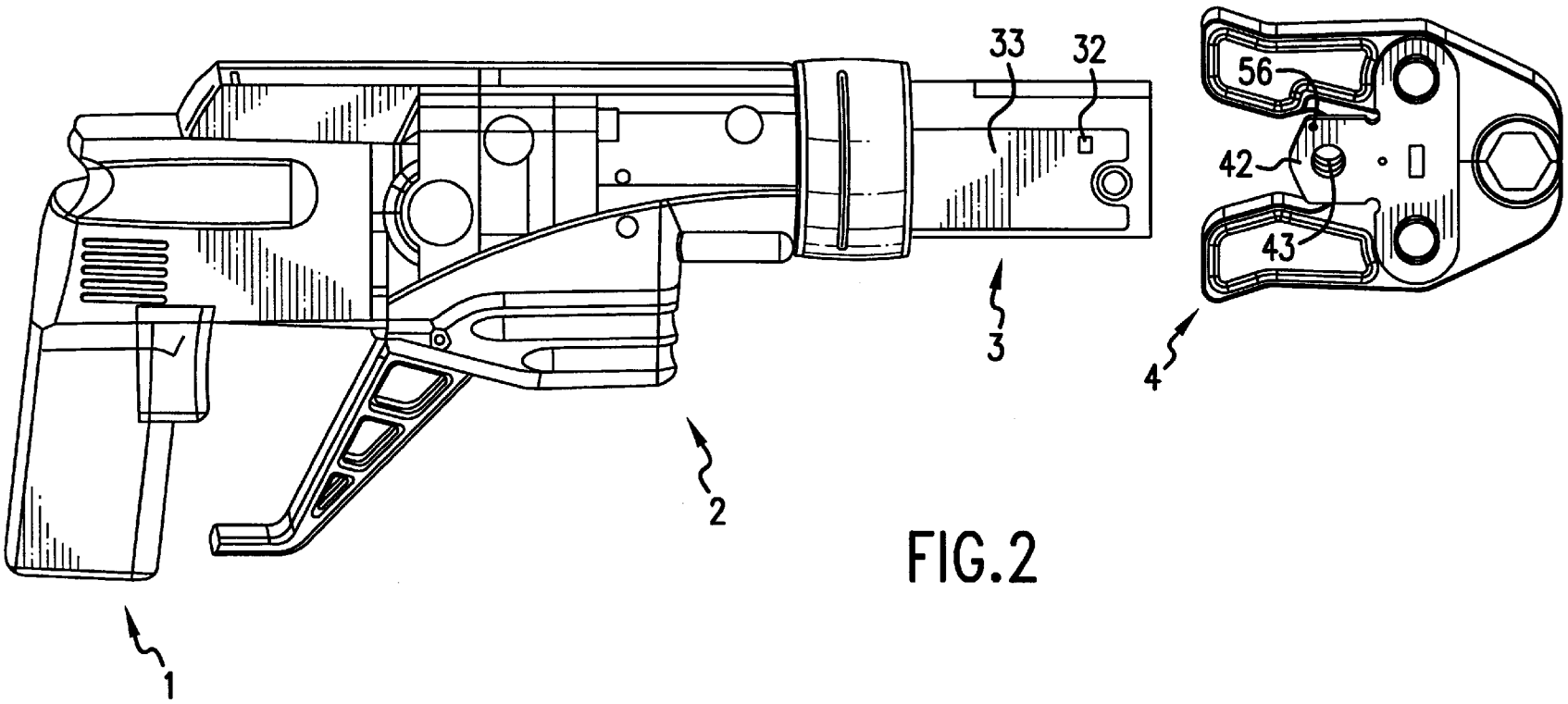
FIG. 2 is an exploded perspective view of another embodiment of a corresponding representation of a second pressing tool with a clamping tool.

A pressing tool for pipe-shaped workpieces is shown in a perspective view in each of FIGS. 1 and 2. The pressing tool comprises an electromechanical or electro-hydraulic device, which is designed in the shape of a pistol. The device, or respectively the pressing tool, has a housing 2 with a grip 1. The pistol-shaped housing 2 terminates in a fork-shaped receiver 3 at an end remote from the grip 1. An interchangeable clamping tool 4 with two clamping jaws 40 is releasably fastened in the fork-shaped receiver 3. Together, the clamping jaws 40 form a circular opening 41 corresponding to a diameter of the workpiece to be pressed. The clamping tool 4 has two clamping jaws 40, which are securely seated between bearing plates 42, shown in detail in FIG. 4. A bore 43, extending vertically with respect to the longitudinal direction of the housing 2, extends through the bearing plates 42. In the assembled state, the bearing plates 42 are enclosed by the fork-shaped receiver 3. The fork-shaped receiver 3 has two lateral jaws 31, through each of which the bore 30 extends. When the clamping tool is assembled, the two bores 30 are aligned with the bores 43 in the bearing plates 42. A connecting bolt 5 can be pushed or passed through the bores 30 and thus can fix the clamping tool 4 in the fork-shaped receiver 3. A drive device, seated in the housing 2 and not shown, acts via a piston rod or a spindle on the clamping tool 4 and thus moves the two clamping jaws 40 in relation toward each other, so that a pressing process can be performed.

Figure 3:
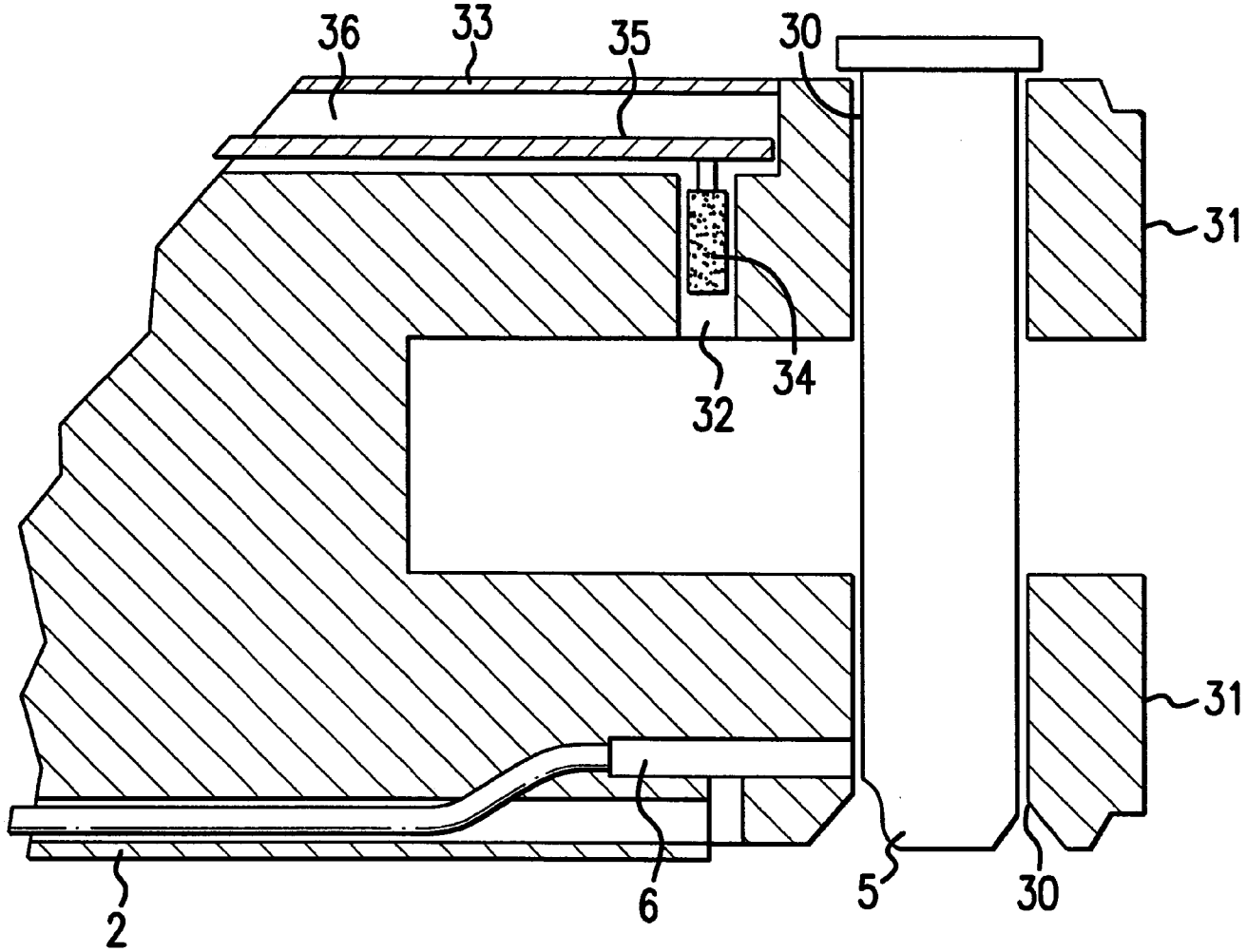
FIG. 3 shows a horizontal section taken through a fork-shaped receiver with a connecting bolt inserted, without a clamping tool.

The correct insertion of the connecting bolt 5 is checked here by means of a monitoring element 6, shown in FIG. 3. The pressing tool can only be operated when the connecting bolt 5 is in a completely inserted position.

The fork-shaped receiver 3 is schematically represented in FIG. 3. Besides the bearing bore 30, which extends in an aligned manner through the two jaws 31, the connecting bolt 5 also guides. In the embodiment shown, a receiving space 36 is milled into one of the two jaws 31 of the receiver 3. The receiving space 36 is covered by a cover plate 33. A printed circuit board 35 is arranged in the receiving space 36. A bore, which is used as a sensor receptacle 32, leads from the receiving space 36 into the space 37 between the two jaws 31. A sensor 34 is arranged in the sensor receptacle 32. The sensor 34 is connected at least electrically with the printed circuit board 35.

If the fork-shaped receiver 3, or respectively the jaws 31, do not provide sufficient space for attaching the receiving space 36, it is also possible for only a single sensor receptacle bore 32 to be provided, in which a sensor 34 is housed, while the printed circuit board 35 with the appropriate electronic devices for signal processing can be housed in the housing 2.

The sensor 34 is an electronic element. The sensor 34 can in principle be a transmitting as well as a receiving unit. However, it is also easily possible to only provide a transmitter, while the receiver can be housed in the oppositely located jaw 31 and can be brought into a communicating connection with the transmitter. In this case monitoring can be provided by a photoelectric or acoustical barrier.

If, however, as in the example shown here, the sensor 34 is only arranged in one jaw 31 of the fork-shaped receiver 3, then the sensor 34 is designed as a transmitting-receiving unit and detects whether a transmitted signal is reflected at all, or is reflected with a predetermined quality. In this case the sensor 34 is employed as a reflection barrier. The reflection barrier can also be operated optically, acoustically or even electro-magnetically. Such means are sufficiently known and their exact design need not be addressed here.

Figure 4:
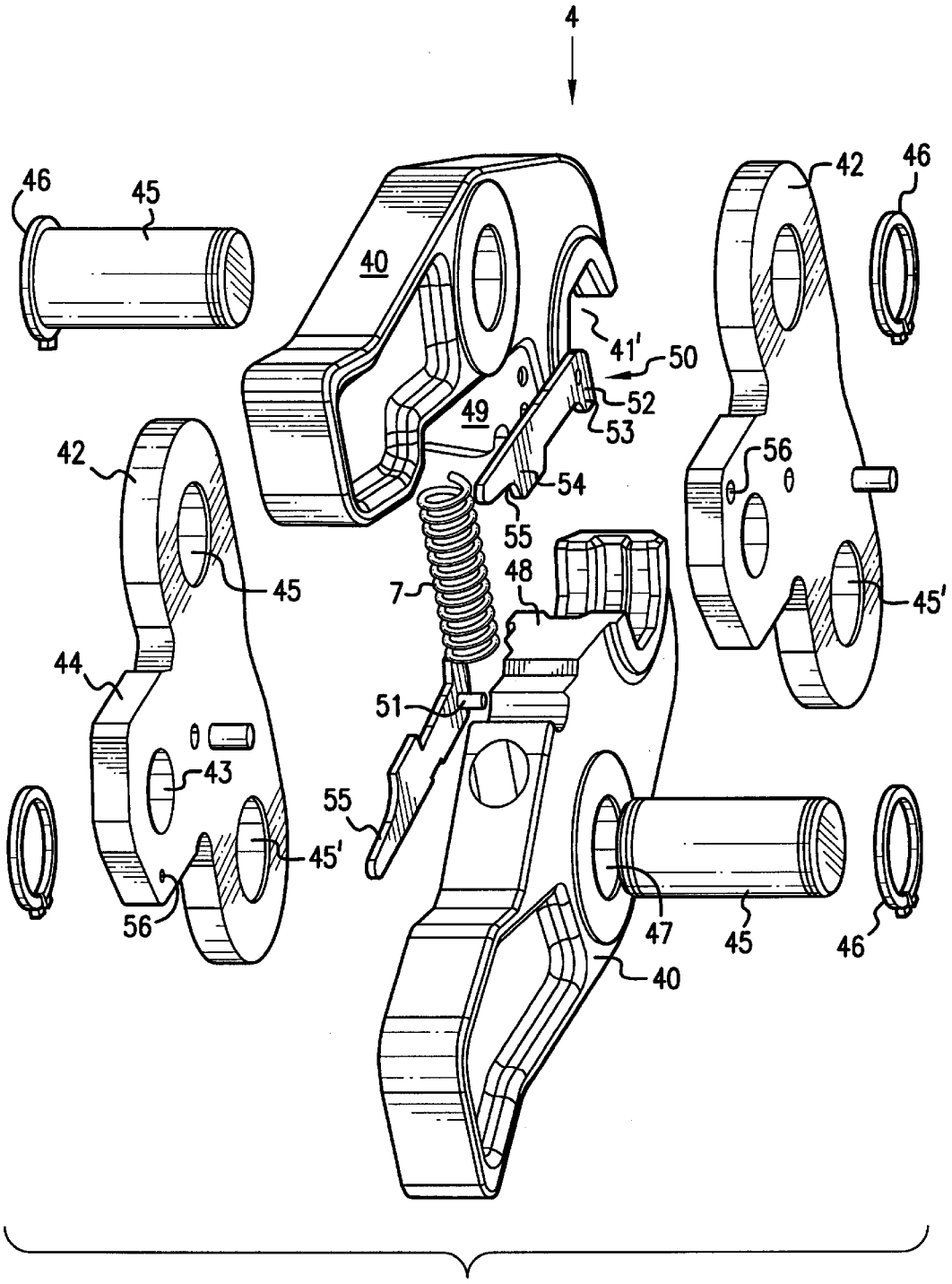
FIG. 4 is an exploded perspective view of another preferred embodiment of a clamping tool.
Figure 5:
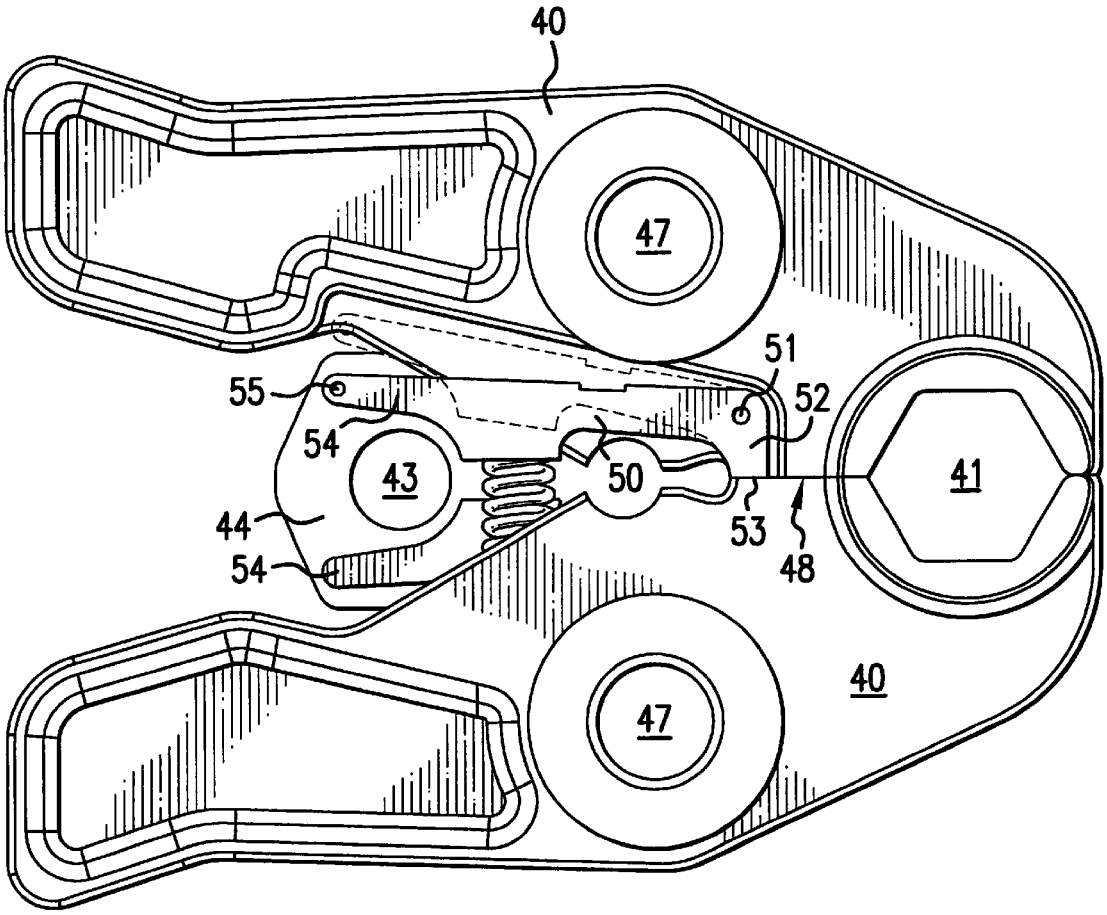
FIG. 5 shows a top view of a clamping tool in an assembled state with a bearing plate on a top omitted.

The clamping tool 4, which is specially designed for a particular embodiment, is shown in FIGS. 4 and 5. The clamping tool 4 has two clamping jaws 40, the same as the clamping tools in accordance with the prior art. Each one of the clamping jaws 40 has half an opening, which together define an opening 41. Grooves or flutes are cut into the half-openings 41", in which the material of the pipe-shaped workpieces, which can be plastically deformed, is received. The two clamping jaws 40 are held between two bearing plates 42. The bearing plates 42 correspondingly have two bearing bores 45" which, in the assembled state of the clamping tool 4, are aligned with each other and with the appropriate bearing bore 47 between the clamping jaws 40. Respectively one bearing bolt 45, which is secured on both ends by retaining rings 46, passes through the bearing bores 45" as well as the bearing bore 47 of the clamping tool 40. A compression spring 7, which is used as a restoring spring, is arranged between the two clamping jaws 40. The compression spring 7 is seated in appropriate blind bores in the two clamping jaws 40. Each clamping jaw 40 has a pressure, or respectively striking surface 48. In the closed state of the clamping tool 4, these two surfaces rest on each other, or at least approximately on each other. In addition, each clamping jaw 40 has a recess 49 which provides space for a pivot lever 50. A pivot shaft 51 accordingly projects from the clamping jaw 40 into the area of the recess 49.

The special shape of the pivot lever 50 is shown in FIG. 5, in particular. With respect to the pivot shaft 41, the pivot lever 50 is two-armed. The two lever arms 52 and 54 extend approximately at right angles with respect to each other. The considerably shorter lever arm 52 has a tracing end 53 which, in the closed state of the clamping tool 4, rests on the pressure surface 48. If the clamping tool is opened, the lever 50 can be pivoted into the position represented by dashed lines. A torsion spring, not shown, which can be arranged around the pivot shaft 51, for example, pushes the pivot lever 50 into a position drawn in dashed lines as long as the clamping tool 4 is opened. In place of a torsion spring it is also possible for another type of spring, for example a relatively small arched spring plate, to provide this function of the restoration of the pivot lever 50.

The pivot lever 50 is designed in such a way that the ratio of length of the two lever arms 52 and 54 is approximately 1:10. This is necessary, because the pivot movement of the clamping jaws 40 during the actual pressing process is relatively small. Accordingly it is necessary to greatly multiply the path, so that it is possible to obtain dependable information despite small movements. When the two clamping jaws 40 are closed toward each other, the tracing end 53 rests on the pressure surface 48, as already mentioned, and the lever arm 54 is pivoted into the position shown in FIG. 5. This can only take place sensibly if the clamping tool 4 is mounted in the fork-shaped receiver 3. In this case the clamping tool 4 projects with the two bearing plates 42, in which the bores 43 are arranged, into the fork-shaped receiver 3, and the connecting bolt 5 extends through the bearing bores 30 in the jaws 31 of the receiver 3, as well as through the two bores 43 of the bearing plates 42. Here, the bearing plates 42 are designed to have a tongue 44, in which the bore 43 is arranged. Thus, the tongue 44 projects into the fork-shaped receiver 3. In principle the tongue 44 covers the sensor receptacle 32 and blocks the signal path of the sensor 34. The bearing plates 42 accordingly have bores 56, through which the sensor signal can pass. The pivot lever 50 pivots suddenly in front of the bores 56 only after the tool 4 is closed. Only when the tool 4 is completely closed does the transmitted signal of the sensors meet a reflector 55, which can be attached in the end area of the lever arm 54. The signal reflected by the reflector 55 then is detected by the receiving unit of the sensor 34, which emits a signal to the control unit, not shown in the drawings. As already previously mentioned, the control unit can be arranged on the printed circuit board 35, or in an area of the housing 2 which is not visible.

Although the embodiments described in this specification are preferred embodiments, they are not the only preferred embodiments. For example, with differently designed clamping tools, other movements can also occur which, however, can also be monitored by a sensor which is housed in the fork-shaped receiver 3. This can also occur indirectly, so that in principle not the clamping jaws, but the piston rod, which acts on the clamping jaws, is detected. However, this can also take place in a completely analogous manner.

This invention is of particular interest because it functions completely independently of the size of the opening 41, or respectively of the size of the clamping tool. For monitoring, it is thus not necessary to provide information regarding the clamping tool used to the logic device. Accordingly, information need not flow from the clamping tool to the pressing tool. Therefore no electrical connection is required between the two units. If the clamping tool is not employed, it is normally closed and the pivot levers 50 are maintained in the extracted position. In this position they are completely protected and covered by the bearing plates 42. Practically no soiling or mechanical wear can occur. The actual tool itself, to which the sensor device is attached, is handled more carefully anyway. Accordingly, soiling occurs here also much more rarely. But the sensor device is completely protected in the jaws 31 of the fork-shaped receiver 3.

What is claimed is:

1. In a pressing tool, for connecting pipe-shaped workpieces, having a fork-shaped receiver, a clamping tool, interchangeably held in the receiver by a connecting bolt and having two clamping jaws which can be moved toward each other, and by a drive motor for operating the clamping tool, wherein the connecting bolt can be pushed through bores in the fork-shaped receiver and in the clamping tool for maintaining the clamping tool exchangeably in the fork-shaped receiver, the improvement comprising:

a contactless electronic tracing device being one of an optically operating sensor and an acoustically operating sensor arranged in the fork-shaped receiver which determines a relative position of the clamping jaws in relation to the fork-shaped receiver and passes a signal to at least one of an optical warning device and an acoustical warning device, the fork-shaped receiver having two at least approximately parallel jaws, and a sensor element is arranged in each of the jaws from which one of a passage and an interruption of the signal from the one jaw to the other jaw can be checked.

2. The pressing tool in accordance with claim 1, wherein a transmitter and a receiver element is provided in a single element of the fork-shaped receiver, and the signal transmitted by the transmitter element is reflected at a clamping tool element when the clamping tool attains an end position.

3. The pressing tool in accordance with claim 2, wherein a two-armed lever is arranged on at least one of the clamping jaws of the clamping tool, and when the clamping tool is closed a pivot lever pivots into a signal path of the sensor arranged in the fork-shaped receiver so that the signal of the transmitter is reflected at the pivot lever.

4. The pressing tool in accordance with claim 3, wherein the two-armed pivot lever has a reflector surface.

5. The pressing tool in accordance with claim 3, wherein the pivot lever is seated in a recess of a clamping jaw and pivots around a shaft and has a tracing end which can contact with the other of the clamping jaws.

6. The pressing tool in accordance with claim 5, wherein the two-armed pivot lever has one arm which when pivoted into the signal path is several times longer than the arm which has a tracing end.

7. The pressing tool in accordance with claim 5, wherein the pivot lever is arranged in each of the clamping jaws.

8. In a pressing tool, for connecting pipe-shaped workpieces, having a fork-shaped receiver, a clamping tool, interchangeably held in the receiver by a connecting bolt and having two clamping jaws which can be moved toward each other, and by a drive motor for operating the clamping tool, wherein the connecting bolt can be pushed through bores in the fork-shaped receiver and in the clamping tool for maintaining the clamping tool exchangeably in the fork-shaped receiver, the improvement comprising:

a contactless electronic tracing device arranged in the fork-shaped receiver which determines a relative position of the clamping jaws in relation to the fork-shaped receiver and passes a signal to at least one of an optical warning device and an acoustical warning device, the two clamping jaws pivotably arranged between two bearing plates, and the bearing plates having recesses through which the signal can pass.

9. The pressing tool in accordance with claim 7, wherein the two pivot levers are symmetrically arranged on each one of the clamping jaws so that the clamping tool can be used in two possible assembled positions.

10. In a pressing tool, for connecting pipe-shaped workpieces, having a fork-shaped receiver, a clamping tool, interchangeably held in the receiver by a connecting bolt and having two clamping jaws which can be moved toward each other, and by a drive motor for operating the clamping tool, wherein the connecting bolt can be pushed through bores in the fork-shaped receiver and in the clamping tool for maintaining the clamping tool exchangeably in the fork-shaped receiver, the improvement comprising:

a contactless electronic tracing device being one of an optically operating sensor and an acoustically operating sensor arranged in the fork-shaped receiver which determines a relative position of the clamping jaws in relation to the fork-shaped receiver and passes a signal to at least one of an optical warning device and an acoustical warning device, the fork-shaped receiver having two at least approximately parallel jaws, a sensor element arranged in a bore in one of the jaws and directed into a space between the two jaws to trace a relative position of one of the jaws with respect to the fork-shaped receiver.

* * * * *